US007415810B2

(12) United States Patent
Plourde et al.

(10) Patent No.: US 7,415,810 B2
(45) Date of Patent: Aug. 26, 2008

(54) METHODS OF MANUFACTURING HOODED SLIDER-OPERATED ZIPPERED BAGS

(75) Inventors: Eric Paul Plourde, Homewood, IL (US); Timothy S. McLaren, Kankakee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 661 days.

(21) Appl. No.: 10/946,997

(22) Filed: Sep. 22, 2004

(65) Prior Publication Data

US 2006/0062495 A1 Mar. 23, 2006

(51) Int. Cl.
*B65B 61/18* (2006.01)

(52) U.S. Cl. ..... 53/412; 53/451; 53/133.4; 53/139.2; 53/551; 383/61.2; 383/64; 493/213

(58) Field of Classification Search ..... 53/412, 53/450, 451, 133.4–133.8, 139.2, 550, 551; 493/213; 383/61.2, 64, 203
See application file for complete search history.

(56) References Cited

U.S. PATENT DOCUMENTS

| | | | | |
|---|---|---|---|---|
| 6,178,722 | B1 | 1/2001 | McMahon | |
| 6,212,857 | B1 | 4/2001 | Van Erden | |
| 6,286,191 | B2 | 9/2001 | Van Erden | 24/399 |
| 6,402,376 | B1 | 6/2002 | Bois | |
| 6,505,383 | B2 * | 1/2003 | Machacek et al. | 24/30.5 R |
| 6,517,242 | B1 | 2/2003 | Buchman | |
| 2002/0134046 | A1 * | 9/2002 | Bois | 53/133.4 |
| 2002/0194818 | A1 * | 12/2002 | Thieman | 53/412 |
| 2003/0050167 | A1 * | 3/2003 | Kinigakis et al. | 493/394 |
| 2003/0056470 | A1 * | 3/2003 | Schneider et al. | 53/412 |
| 2003/0099412 | A1 | 5/2003 | Schneider et al. | 383/5 |
| 2003/0103690 | A1 | 6/2003 | Schneider et al. | |

FOREIGN PATENT DOCUMENTS

| | | |
|---|---|---|
| EP | 1 457 428 A | 9/2004 |

* cited by examiner

*Primary Examiner*—Stephen F Gerrity
(74) *Attorney, Agent, or Firm*—Ostrager Chong Flaherty & Broitman P.C.

(57) ABSTRACT

A method of manufacturing a reclosable package having a hooded slider-operated zipper, comprising the following steps: (a) interlocking profiled closure members of first and second flanged zipper strips; (b) inserting a slider on the zipper strips; (c) folding zipper flanges of the first and second flanged zipper strips so that respective portions of the zipper flanges confront each other at a position above the profiled closure members; (d) joining the mutually confronting portions of the zipper flanges to each other to form a hood over the profiled closure members; (e) guiding first and second portions of web material into mutual confrontation; (f) guiding the mutually interlocked first and second zipper strips to positions whereat a portion of one zipper flange confronts the first portion of web material and a portion of the other zipper flange confronts the second portion of web material; and (g) joining respective portions of the zipper flanges to the first and second portions of web material respectively. The resulting assembly is then cross-sealed, filled with product, cross-sealed again, and then cut along the second cross seal to sever a filled package from the work in process.

26 Claims, 6 Drawing Sheets

METHODS OF MANUFACTURING HOODED SLIDER-OPERATED ZIPPERED BAGS

BACKGROUND OF THE INVENTION

The present invention relates to reclosable bags having hooded slider-operated zippers. More particularly, the present invention relates to methods and apparatus for making hooded slider-operated zippered bags on form-fill-seal (FFS) machines.

Reclosable bags are finding ever-growing acceptance as primary packaging, particularly as packaging for foodstuffs such as cereal, fresh fruit and vegetables, cold cuts, snacks and the like. Such bags provide the consumer with the ability to readily store, in a closed, if not sealed, package any unused portion of the packaged product even after the package is initially opened.

Reclosable bags comprise a receptacle having a mouth with a plastic zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper strips can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Various additions to reclosable bags have been made to provide tamper-evident seals or indicators that will reveal when the bag has been opened or otherwise tampered with prior to purchase by the consumer. It is known to provide a reclosable package construction that is designed to undergo some permanent change in the package appearance when the package is opened for the first time. For example, it is known to provide a reclosable package with a tamper-evident, non-reclosable peel seal that gives a positive indication of having been broken when a package is first opened. It is also known to shroud the zipper (with or without slider) inside an enclosed header on the top of the bag. Another type of tamper-evident feature is the provision of a membrane on the product side of the zipper that partitions the interior volume in an airtight manner.

In the formation of reclosable plastic bags when the bags are used for foodstuffs and like material, it is advantageous to have the bags supplied with a tamper-evident seal which not only protects the contents from the ingress of foreign materials and contamination, but also shows if inadvertent or intentional opening has occurred prior to the bag and its contents being in the possession of the buyer. Such a protective seal, if formed externally of the reclosable seal rather than internally, can additionally protect the reclosable zipper elements from dust and dirt and other contaminants with a permanent protective seal located outwardly of the reclosable seal. Moisture and other foreign elements cannot enter the bag and the purchaser can see that he is obtaining a previously unopened and unused bag where the contents are fully protected. This conveys a feeling of safety and comfort to the purchaser who may be concerned about someone criminally obtaining access to the bag and placing dangerous contaminants into the contents.

U.S. Pat. No. 6,212,857 discloses a reclosable package having a slider-zipper assembly wherein long zipper flanges are wrapped around the zipper profiles and joined to each other above the zipper profiles, thereby forming a tamper-evident hood. This patent also discloses that such reclosable packages can be manufactured on a VFFS machine having longitudinal seal bars adjacent the fill tube for joining the zipper flanges to the walls of the package.

There is a continuing need for improved methods of manufacturing reclosable bags having hooded slider-operated zippers.

BRIEF DESCRIPTION OF THE INVENTION

The present invention is directed to methods for manufacturing hooded slider-operated zippered bags. The invention is further directed to reclosable bags having a hooded slider-operated zipper.

One aspect of the present invention is a method of manufacture comprising the following steps: (a) interlocking a first profiled closure member of a first flanged zipper strip with a second profiled closure member of a second flanged zipper strip; (b) inserting a slider on the first and second flanged zipper strips; (c) folding a first zipper flange of the first flanged zipper strip and folding a second zipper flange of the second flanged zipper strip so that respective portions of the first and second zipper flanges confront each other at a position above the first and second profiled closure members; (d) joining the mutually confronting portions of the first and second zipper flanges to each other to form a hood over the first and second profiled closure members; (e) guiding first and second portions of web material into mutual confrontation; (f) guiding the mutually interlocked first and second zipper strips to positions whereat a portion of the first zipper flange confronts the first portion of web material and a portion of the second zipper flange confronts the second portion of web material; (g) joining the portion of the first zipper flange to the first portion of web material; and (h) joining the portion of the second zipper flange to the second portion of web material.

Another aspect of the present invention is a method of manufacture comprising the following steps: (a) interlocking a first profiled closure member of a first flanged zipper strip with a second profiled closure member of a second flanged zipper strip; (b) inserting a slider on the first and second flanged zipper strips; (c) folding a first zipper flange of the first flanged zipper strip and folding a second zipper flange of the second flanged zipper strip so that respective portions of the first and second zipper flanges confront each other at a position above the first and second profiled closure members; (d) joining the mutually confronting portions of the first and second zipper flanges to each other to form a hood over the first and second profiled closure members; (e) guiding a web of bag making material in a machine direction through a vertical form-fill-seal (VFFS) machine with a portion or portions of the web being wrapped around a tube; and (f) respectively joining portions of the first and second zipper flanges to first and second fin portions of the web that do not form part of the portion or portions of the web that are wrapped around the tube.

A further aspect of the present invention is a method of manufacture comprising the following steps: (a) interlocking a first profiled closure member of a first flanged zipper strip with a second profiled closure member of a second flanged zipper strip; (b) inserting a slider on the first and second flanged zipper strips; (c) folding a first zipper flange of the first flanged zipper strip and folding a second zipper flange of the second flanged zipper strip so that respective portions of the first and second zipper flanges confront each other at a position above the first and second profiled closure members; (d) joining the mutually confronting portions of the first and second zipper flanges to each other to form a hood over the first and second profiled closure members; (e) guiding a web of bag making material into a configuration whereby first and second marginal portions of the web confront each other; (f) guiding the mutually interlocked first and second zipper strips to positions whereat a portion of the first zipper flange confronts a portion of the first marginal portion of the web and a portion of the second zipper flange confronts a portion of the second marginal portion of the web; (g) joining the portion of the first zipper flange to the portion of the first marginal portion of the web; and (h) joining the portion of the second zipper flange to the portion of the second marginal portion of the web.

Yet another aspect of the present invention is a package comprising: a hooded zipper comprising first and second flanged zipper strips, the first flanged zipper strip comprising a first base, a first profiled closure member projecting from the first base and a first zipper flange connected to the first base, and the second flanged zipper strip comprising a second base, a second profiled closure member projecting from the second base and a second zipper flange connected to the second base, the first profiled closure member being interlockable with the second closure member, the first and second zipper flanges being folded back so that exterior surfaces of respective first portions of the first and second flanges confront each other above the first and second bases, and interior surfaces of respective second portions of the first and second flanges confront each other below the first and second bases, the respective first portions of the first and second zipper flanges being joined together at a first seal to form a hood that covers the first and second bases; a slider mounted to the first and second bases; and first and second walls of flexible bag making material joined or connected to each other on three sides to form a receptacle having an interior volume and a mouth, the hooded zipper being attached to the receptacle so that the hooded zipper closes the mouth, wherein each of the first and second walls has a marginal portion along a respective edge, a portion of the marginal portion of the first wall being joined to the interior surface of the second portion of the first zipper flange, and a portion of the marginal portion of the second wall being joined to the interior surface of the second portion of the second zipper flange.

A further aspect of the present invention is a package comprising: a hooded zipper comprising first and second flanged zipper strips, the first flanged zipper strip comprising a first base, a first profiled closure member projecting from the first base and a first zipper flange connected to the first base, and the second flanged zipper strip comprising a second base, a second profiled closure member projecting from the second base and a second zipper flange connected to the second base, the first profiled closure member being interlockable with the second closure member, the first and second zipper flanges being folded back so that exterior surfaces of respective first portions of the first and second flanges confront each other above the first and second bases, and interior surfaces of respective second portions of the first and second flanges confront each other below the first and second bases, the respective first portions of the first and second zipper flanges being joined together at a first seal to form a hood that covers the first and second bases; a slider mounted to the first and second bases; and first and second walls of flexible bag making material joined or connected to each other on three sides to form a receptacle having an interior volume and a mouth, the hooded zipper being attached to the receptacle so that the hooded zipper closes the mouth, wherein the second portion of the first zipper flange is joined to a third portion of the first zipper flange, and the second portion of the second zipper flange is joined to a third portion of the second zipper flange.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
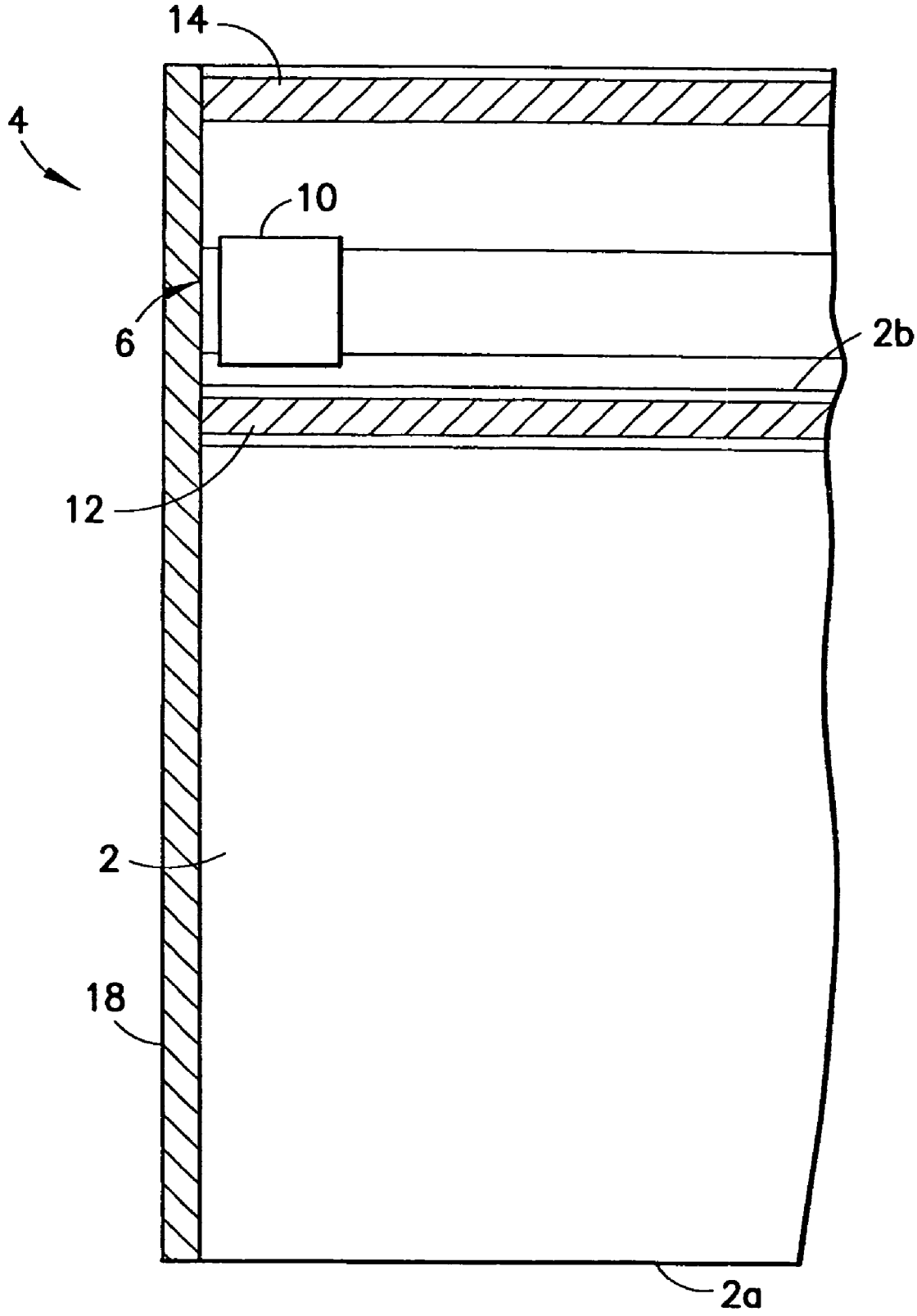
FIG. 1 is a drawing showing a portion of a reclosable package having a hooded slider-operated zipper.
Figure 6:
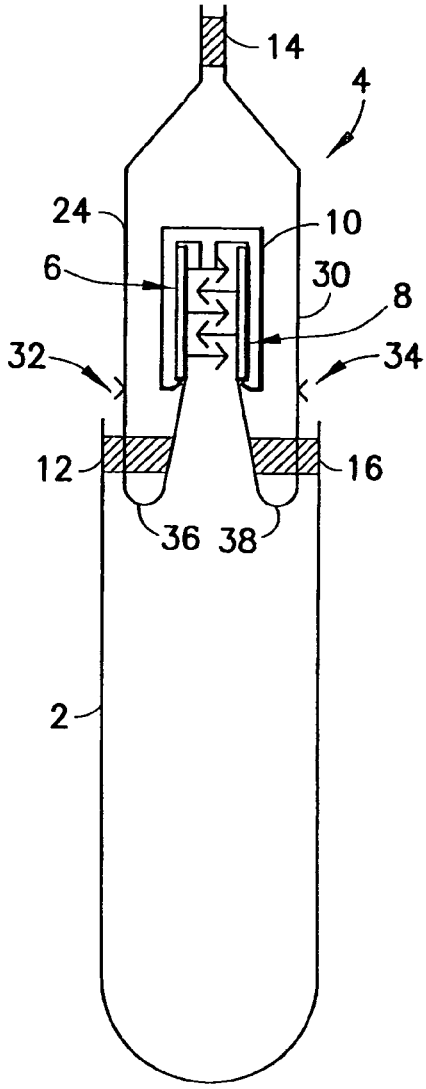

A reclosable bag comprising a receptacle 2 and hooded slider-zipper assembly 4 is shown in FIGS. 1 (front view) and 6 (sectional view). The hooded slider-zipper assembly 4 comprises a flexible plastic zipper operated by manipulation of a slider 10. As seen in FIG. 6, the zipper comprises a pair of zipper strips 6 and 8 having long flanges 24 and 30 that are folded back and joined together at a top seal 14 to form a hood that covers the interlockable portions of the zipper until such time as a major portion of the hood is torn off by the consumer, thereby providing access to the slider 10. After a major portion of the hood has been removed, the closure members of the zipper strips 6 and 8 can be disengaged from each other by moving the slider in an opening direction, thereby opening the zipper and allowing access to the contents of the bag. The bag can thereafter be reclosed by moving the slider in a closing direction opposite to the opening direction.

Referring still to FIGS. 1 and 6, the receptacle 2 comprises opposing walls (only the front panel is visible in FIG. 1) that may be secured together at opposite side edges of the bag by seams 18 (only one of which is seen in FIG. 1) formed in conventional fashion, e.g., by application of heat and pressure. In this embodiment, the walls of the receptacle are opposing portions of a folded web of bag making material. As seen in FIG. 1, a fold 2*a* is disposed at the bottom of the receptacle, while an edge of the front wall is designated 2*b* in FIG. 1. The upper margins of the front and rear walls of the receptacle 2 form a mouth to which the hooded slider-zipper assembly 4 is attached (see FIG. 6), as will be described in greater detail later when various methods of manufacture are disclosed. Typically the upper margins of the front and rear walls of the receptacle 2 (or portions thereof if free edges of the wall extend beyond the zones of joinder) are respectively sealed to the flanges of the respective zipper strips by conduction heat sealing. FIG. 6 shows respective zipper/receptacle zones of joinder 12 and 16.

The zipper may comprise a pair of interlockable zipper strips 6 and 8 made of extruded plastic. One zipper part 6 is visible in FIG. 1. The profiles of the zipper parts may take any form. For example, the zipper may comprise interlocking rib and groove elements, alternating hook-shaped closure elements, or interlocking ball-shaped closure elements. The preferred zipper material is polyethylene, but polypropylene or other plastic material could also be used.

The reclosable bags disclosed herein further comprise end stops (not shown in FIG. 1) for preventing the slider from sliding off either end of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. The end stops typically comprise stomped areas on the zipper parts themselves. The stomped end stops comprise sections of the zipper parts that have been fused together and flattened at the ends of the zipper. This is typically accomplished by applying ultrasonic wave energy, but alternatively can be done by applying sufficient heat and pressure. Ultrasonic stomping can be carried out using ultrasonic welding equipment of the type disclosed in U.S Pat. No. 6,733,622 entitled "Method and Apparatus for Ultrasonically Stomping Slider End Stops on Zipper".

The bag 2 may be made from any suitable bag making film material, including a single layer of thermoplastic material or a laminate comprising two or more layers made of different materials. For example, the laminate could comprise two layers of different thermoplastic materials, a plastic-coated paper or a metallized thermoplastic film. Suitable thermoplastic materials include low-density polyethylene, substantially linear copolymers of ethylene and a C3-C8 alpha-olefin, polypropylene, polyvinylidene chloride, mixtures of two or more of these polymers, or mixtures of one of these polymers with another thermoplastic polymer. The person skilled in the art will recognize that this list of suitable thermoplastic materials is not exhaustive.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

Figure 2:
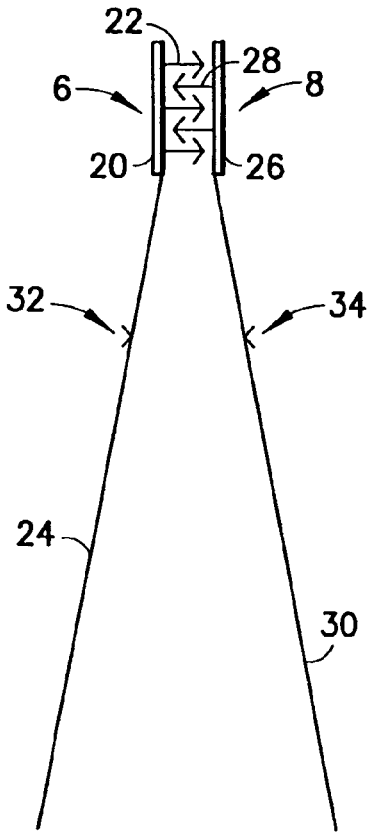
FIGS. 2-6 are drawings showing respective stages in a method of manufacture in accordance with one embodiment of the invention.

Various stages in one method of manufacturing a reclosable package having a hooded slider-operated zipper are shown in FIGS. 2-6. FIG. 2 shows a pair of flanged zipper parts 6 and 8 (made of thermoplastic material) in a mutually interlocked state. Each of the zipper parts 6 and 8 is a continuous strip formed by extrusion, which will later be cut into segments, one zipper segment being attached to each bag. The zipper strip 6 comprises a base 20, a plurality of profiled closure members 22 projecting from one side of the base 20, and a long zipper flange 24 connected to one edge of the base 20. Similarly, the zipper part 8 comprises a base 26, a plurality of profiled closure members 28 projecting from one side of the base 26, and a long zipper flange 30 connected to one edge of the base 26. Although FIG. 2 depicts zipper strips having plural profiled closure members, at a minimum each zipper strip could have only one closure member.

FIG. 2 also shows that the zipper flanges 24, 30 have respective lines of weakened tear resistance 32, 34 (hereinafter "tear lines") formed therein. These tear lines are preferably formed after extrusion of the zipper strips and before the zipper strips are interlocked with each other. The tear line on each zipper strip is a straight line extending substantially parallel to the base of the respective zipper strip. The tear lines may be formed by any conventional means, including, but not limited to, laser scoring, perforating or a narrowing in the extrusion die orifice. For example, each zipper flange may be provided with a line of spaced perforations running the length of the flange and parallel to the closure profiles. In cases where the space under the hood needs to be hermetically sealed, each line of perforations may be capped by a respective sealing stripe (not shown), as taught in U.S. Pat. No. 5,063,639. The sealing stripe may be heat sealed to the zipper flange in a band-shaped zone that extends on both sides of the respective perforated line. Such a sealing stripe effectively hermetically seals the perforations, while still leaving the line of weakened tear resistance provided by the perforations.

Figure 3:
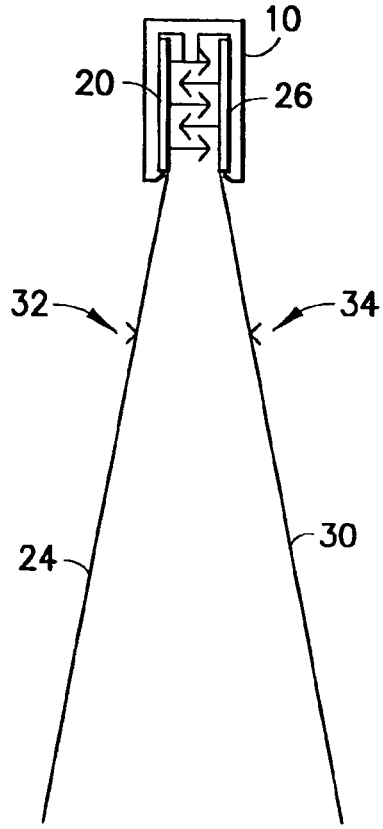
Figure 4:
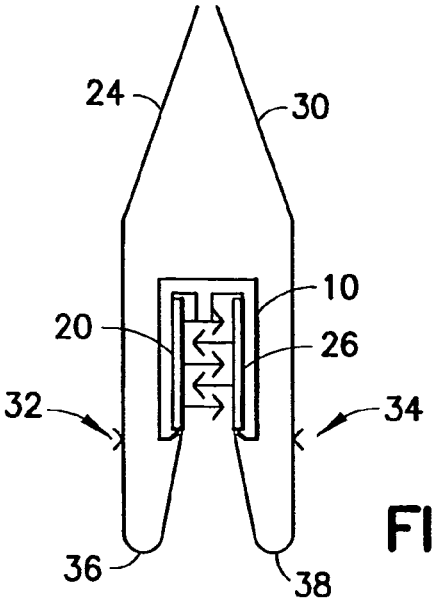
Figure 5:
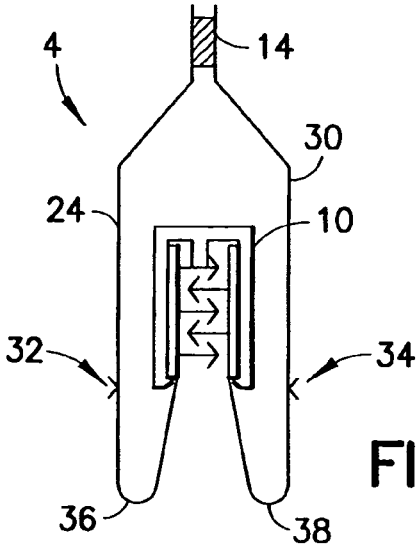

After the zipper flanges have been provided with tear lines 32 and 34, the closure profiles 22, 28 are brought into alignment and interlocked to close the zipper, as seen in FIG. 2. The tear lines 32, 34 are located at approximately the same elevation and parallel to each other when the zipper strips are interlocked. In the next stage of manufacture depicted in FIG. 3, sliders 10 are inserted onto the continuous interlocked zipper material at regular spaced intervals, one slider per package-width segment of the zipper material. Then the zipper flanges 24 and 30 are folded back and wrapped around the base portions of the zipper strips, as seen in FIG. 4. The zipper flanges are folded in opposite directions, with the end result being that the marginal portions at the edges of the zipper strips are mutually confronting. The fold line 36 in zipper flange 24 is placed at a location between the tear line 32 and the base 20, with the fold line 36 being substantially parallel to the base 20; similarly, the fold line 38 in zipper flange 30 is placed at a location between the tear line 34 and the base 26, with the fold line 38 being substantially parallel to the base 26. As seen in FIG. 5, the tear lines 32 and 34 are located on the zipper flanges so that when the flanges are folded, the tear lines lie at an elevation slightly below the bases of the zipper strips 6, 8, thereby exposing the slider and zipper when the portion of the hood above the tear lines is torn off.

In the next stage of manufacture, respective portions of the marginal portions of the folded zipper flanges 24 and 30 are joined together by any conventional means. For example, confronting portions of the folded zipper flanges can be joined in a band-shaped zone by conventional conduction heat sealing, during which sufficient heat and pressure are applied by a pair of sealing bars (at least one of which is heated) to cause the thermoplastic material of the zipper flanges to soften or melt in the zone of joinder. When the softened or melted thermoplastic material cools, it fuses to form a band-shaped permanent heat seal 14, as seen in FIG. 5. This heat seal in turn joins the zipper flanges together to form a hood that covers the bases and closure profiles of the zipper strips and the sliders spaced at intervals along the zipper, thereby forming a hooded slider-zipper assembly 4. The final hooded slider-zipper assembly 4 is continuous and can be wound on a spool or reel for transport to a form-fill-seal (FFS) machine. Alternatively, the hooded slider-zipper assembly 4 can be fed directly to a FFS machine without being wound on a spool or reel.

In either case, the hooded slider-zipper assembly 4 is then joined to the marginal portions of a web 2 of bag making material, such as thermoplastic film, as seen in FIG. 6. In this particular embodiment, the marginal portions of the web 2 are guided into respective positions of mutual confrontation, and then the folded portions 36 and 38 of the zipper flanges 24 and 30 are placed between the marginal portions of the web 2. A separator plate (not shown in FIG. 6) may be placed between the folded portions 36 and 38 of the zipper flanges 24 and 30 to prevent seal-through of the zipper flanges to each other during the web-to-zipper sealing operation. The latter operation may again be carried out in conventional fashion using a pair of reciprocating heated sealing bars (not shown in FIG. 6), one sealing bar being located on each side of the separator plate. During the sealing operation, one heated sealing bar is extended to press one marginal portion of the web 2 and two layers of zipper flange near fold 36 against one side of the separator plate, applying sufficient heat to soften or melt the zipper flange material (or sealant material applied on surfaces thereof) and, optionally, also the web material, resulting in the formation of a band-shaped permanent heat seal 12 when the softened or melted material fuses; and the other heated sealing bar is extended to press the other marginal portion of the web 2 and two layers of zipper flange near fold 38 against the other side of the separator plate, again applying sufficient heat to soften or melt the zipper flange material (or sealant material applied on surfaces thereof) and, optionally, also the web material, resulting in the formation of a band-shaped permanent heat seal 16 when the softened or melted material fuses. In the case of a horizontal FFS machine, the web is folded and then cross-sealed to form a chain of pockets, which are then filled in succession before the hooded slider-zipper assembly is attached. In the case of a vertical FFS machine, the web is wrapped around a fill tube with its marginal portions being directed radially outward to form respective fin portions. The hooded slider-zipper assembly is attached to each successive section of the web, each section of the resulting assembly being then advanced downward, cross-sealed at an elevation below the fill tube, filled with product via the fill tube, advanced downward again, cross-sealed again, and then cut along the second cross seal to separate the filled bag from the remainder of the work in process.

In each completed filled bag, the tear lines 32 and 34 are located at respective elevations higher than the elevations of the respective permanent seals 12 and 16. The product is contained inside an interior volume of a receptacle formed by web 2, which interior volume communicates with the interior volume of the hooded slider-zipper assembly 4 via any gaps between the closure profiles of the closed zipper, e.g., gaps in front of and behind the plow or separating finger of a slider having a plow or separating finger. However, the total interior volume can be hermetically sealed by means of permanent seals 12, 14 and 16 seen in FIG. 6 and the cross seals (not shown in FIG. 6, which extend from the top seal 14 to the bottom of the receptacle formed by web 2.

The steps of the method of manufacture depicted in FIGS. 2 through 6 can be summarized as follows: (A) provide a flanged zipper having a respective tear line in each flange; (B) insert a slider on the zipper; (C) fold the zipper flanges around the closure profiles of the zipper and the slider; (D) seal respective portions of the zipper flanges together at or near the edges of the folded flanges to form a hood; and (E) seal the zipper flanges to respective portions of a web of bag making material at or near lateral edges of the web. In accordance with alternative methods of manufacture, the order in which method steps (A) through (E) are performed can be rearranged. Some alternatives include the following sequences of steps listed in the order in which they are performed: (I) A-B-E-C-D; (II) A-C-E-B-D; (III) A-C-B-D-E; (IV) A-B-C-E-D; or (V) A-C-B-E-D.

Figure 7:
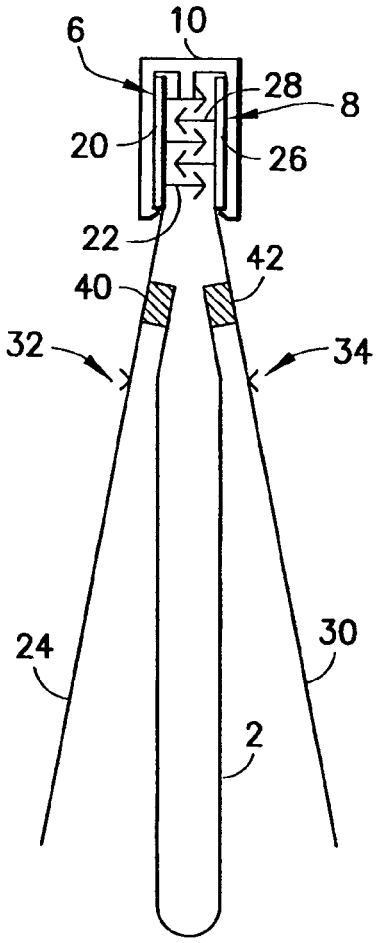
FIGS. 7-9 are drawings showing respective stages in a method of manufacture in accordance with another embodiment of the invention.
Figure 8:
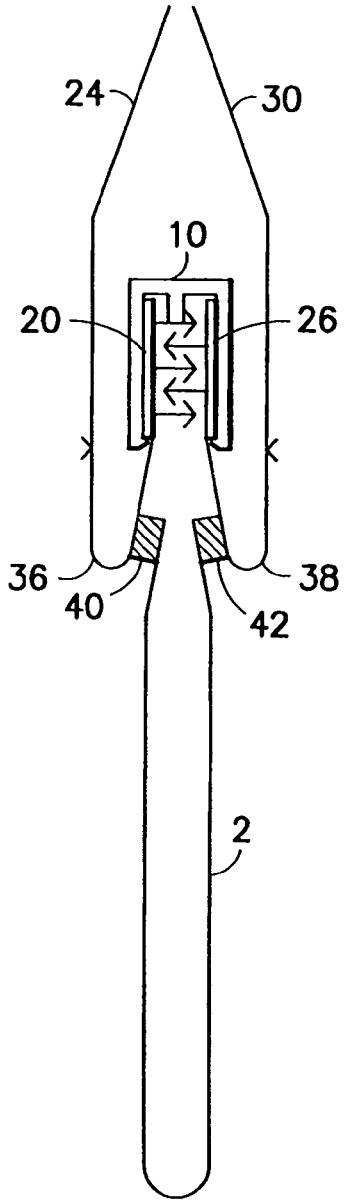
Figure 9:
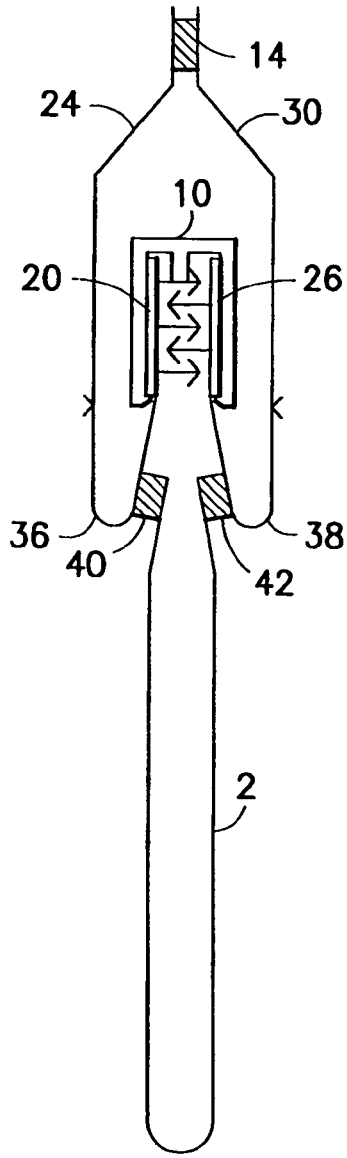

Three stages of a method of manufacture in accordance with variant (I) are depicted in FIGS. 7-9, with two earlier stages being the same as previously described with reference to FIGS. 2 and 3. As seen in FIG. 7, the zipper flanges 24 and 30 are respectively joined to respective portions of a web 2 of bag making material in respective band-shaped zones. The joined portions of the web 2 are respectively located at or near the edges of the web. The joined portion of zipper flange 24 is located between the tear line 32 and the zipper base 20, while the joined portion of zipper flange 30 is located between the tear line 34 and the zipper base 26. After the slider-zipper assembly is attached to the web, the zipper flanges 24 and 39 are folded as shown in FIG. 8. The zipper flanges are folded in opposite directions, with the end result being that the marginal portions at the edges of the zipper flanges are mutually confronting. In the next stage of manufacture, respective portions of the marginal portions of the folded zipper flanges 24 and 30 are joined together by any conventional means to form a band-shaped permanent heat seal 14, as seen in FIG. 9 (and as previously described in greater detail with reference to FIG. 5). As previously described, in the case of a horizontal FFS machine, the web 2 is cross sealed to form pockets that are filled before the hooded slider-zipper assembly is attached to the web, while in the case of a vertical FFS machine, product is loaded after the hooded slider-zipper assembly is attached to the web.

Figure 10:
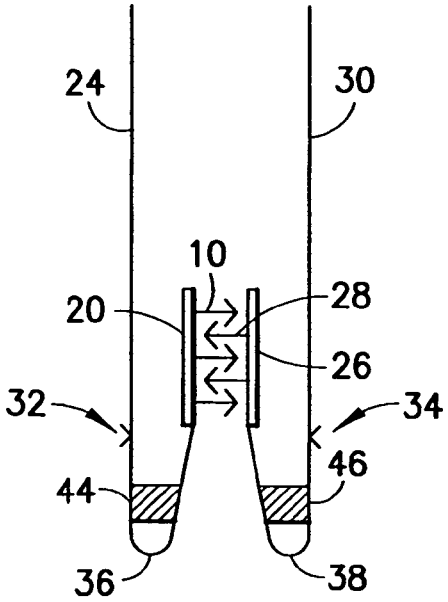
FIGS. 10-13 are drawings showing respective stages in a method of manufacture in accordance with a third embodiment of the invention.
Figure 11:
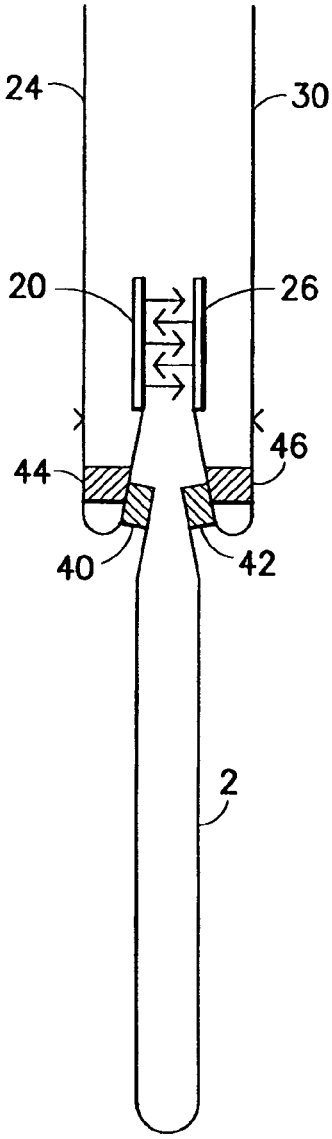
Figure 12:
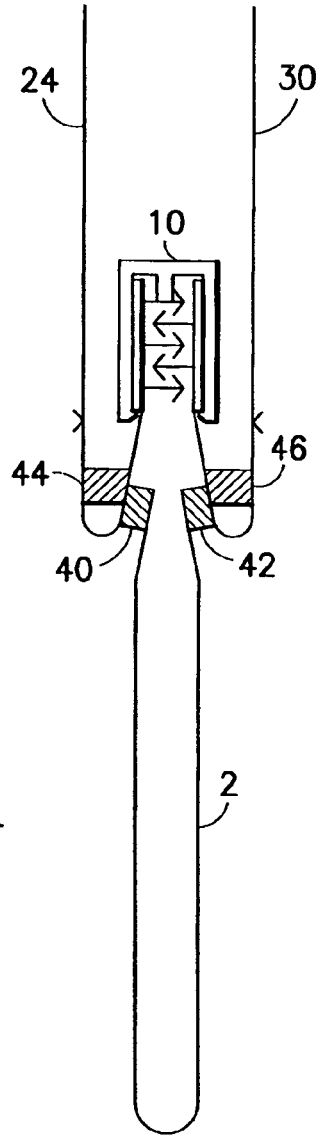
Figure 13:
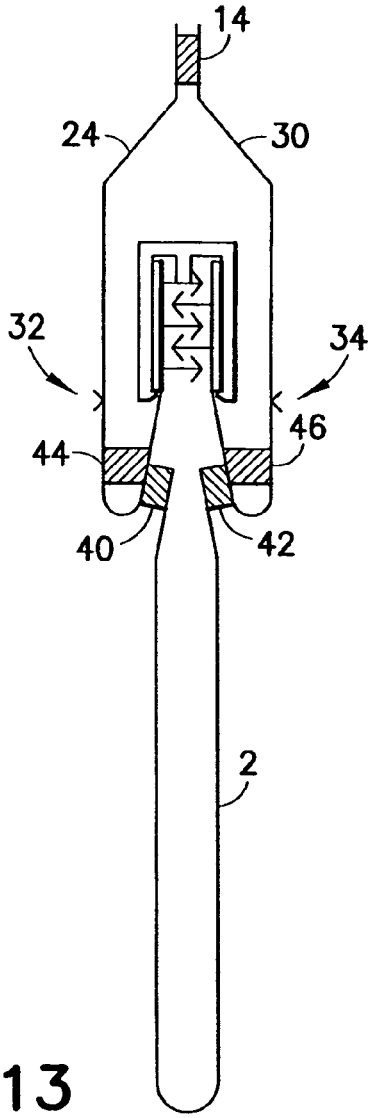

Four stages of a method of manufacture in accordance with variant (II) are depicted in FIGS. 10-13, with an earlier stage being the same as previously described with reference to FIG. 2. As seen in FIG. 10, the zipper flanges 24 and 30 are folded upward and then respective confronting portions of each folded flange are joined together, e.g., by conventional conductive heat sealing, to form zones of joinder 44 and 46 respectively. The zipper with folded flanges sealed in place is then attached to a web 2 of bag making material to form zones of joinder 40 and 42. Again the zipper flanges are joined to respective portions of the web that are at or near the respective edges of the web. A separator plate may be placed between the marginal portions of the web 2 to prevent seal-through during joinder of the zipper to the web. As seen in FIG. 11, the zones of zipper flange joinder 44 and 46 may at least partially overlap the permanent heat seals 40 and 42 respectively. FIG. 12 shows the zipper-web assembly after a slider 10 has been inserted over the zipper bases. FIG. 13 shows the assembly after respective portions of the marginal portions of the folded zipper flanges 24 and 30 are joined to form a band-shaped permanent heat seal 14. As previously described, in the case of a horizontal FFS machine, the web 2 is cross sealed to form pockets that are filled before the hooded slider-zipper assembly is attached to the web, while in the case of a vertical FFS machine, product is loaded after the hooded slider-zipper assembly is attached to the web.

Figure 14:
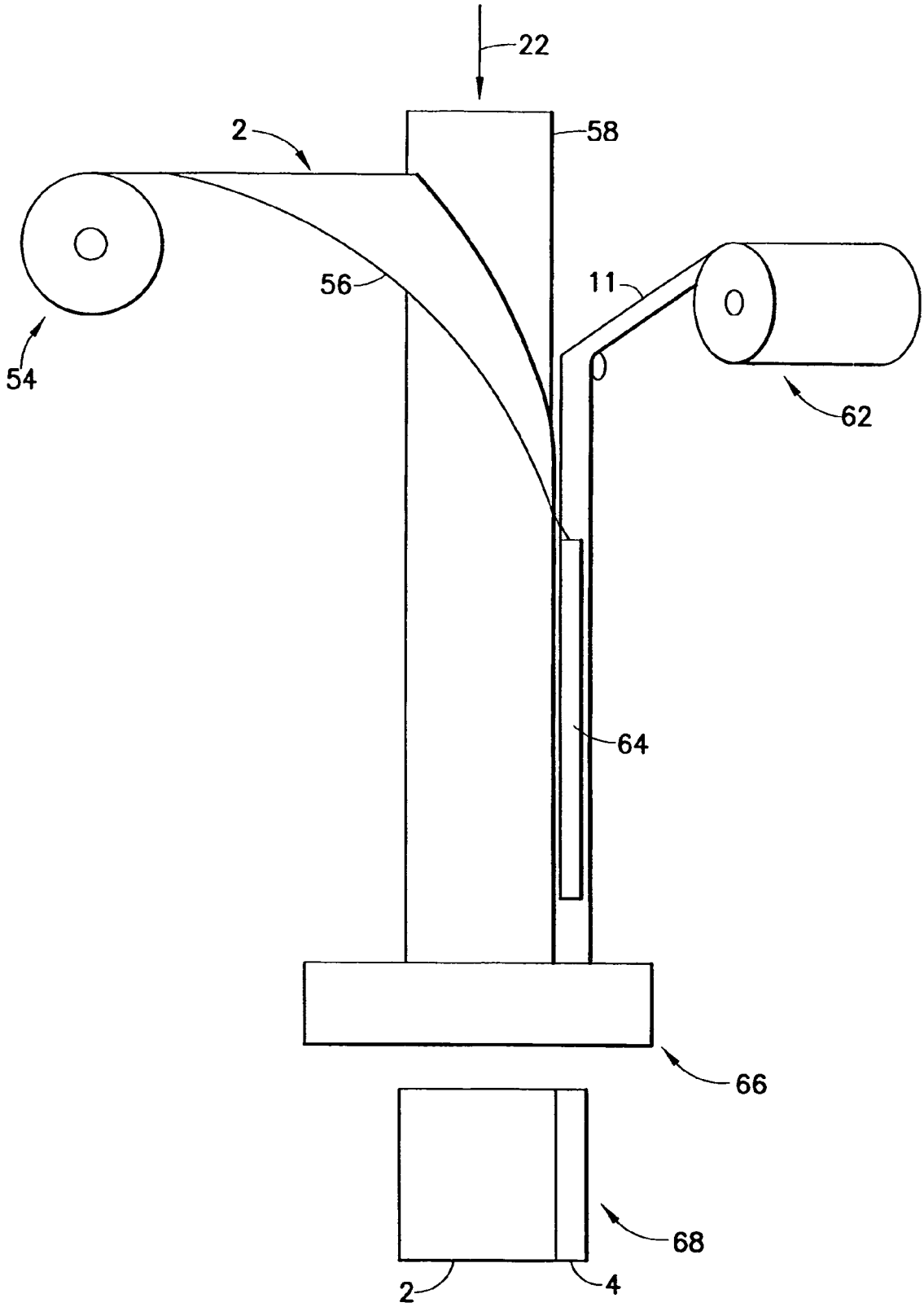
FIG. 14 is a drawing showing an elevational view of a VFFS machine for making packages with hooded slider-zipper assemblies.

FIG. 14 shows packages with hooded slider-zipper assemblies being manufactured on a VFFS machine. The web 2 of packaging film (which ultimately forms the receptacle 2 shown in previous drawings) is fed from a continuous supply roll 54 into the VFFS machine and wrapped around a forming collar 56 and around a filling tube 58 to bring the mutually parallel edges of the film web 2 together to form a tube. The film passes through a generally circular gap (not seen in FIG. 14) between the forming collar 56 and the top of the filling tube 58 in a well-known manner. The marginal portions of the web 2 do not lie against the outer surface of the fill tube, and instead are guided into mutually confronting vertical positions by guiding means (not shown in FIG. 14). The filling tube 58 has an upper funnel end through which product is discharged to fall downwardly into individual packages, which downward movement of product is indicated by arrow 60 in FIG. 14.

Still referring to FIG. 14, at the same time that the film web 2 is being fed and guided, a hooded slider-zipper assembly 4 is fed from a continuous coil on a supply reel or spool 62. The hooded assembly is guided downwardly by other guide means (not shown in FIG. 14) into one of the respective positions whereat the folds of the zipper flanges respectively confront the marginal portions (i.e., fins) of the tube-wrapped portion of the film web 2. For example, in accordance with the method step depicted in FIG. 6, the folded zipper flanges of the hooded assembly are placed between the fins of the web 2. In accordance with one alternative (not shown in the drawings), the hooded assembly is guided into a position whereat the fins of the web are placed between the folded zipper flanges. In accordance with other alternative methods, the zipper assembly being guided into position has not yet been provided with a hood, as seen in FIG. 7 or 11. In the case where the zipper flanges of the zipper assembly have not yet been folded, the zipper flanges are placed outside the fins of the web 2, as seen in FIG. 7. In the case where the zipper flanges have been folded but not yet sealed together, either the fins of the web 2 can be placed between the folded zipper flanges of the zipper assembly, as seen in FIG. 11, or the fins of the web can be placed outside the folded zipper flanges (not shown in the drawings).

Regardless of the specific configuration being employed, the common aspect is that the guiding means for the web 2 of packaging film guide the fins of the web to positions inside (or outside) and overlapping with respective portions of the zipper flanges of the slider-zipper assembly. The zones of overlap may be disposed on opposing sides of a separator plate (not shown in FIG. 14), passing through respective gaps between the separator plate and a pair of mutually opposing vertical heated seal bars (only one of which, designated by numeral 64, is shown in FIG. 14). The vertical seal bars reciprocate between extended and retracted positions. During each dwell time between successive advancements of the web of film in the machine direction, the vertical heated seal bars are extended to positions whereat the overlapping web fins and zipper flanges are pressed against the separator plate while sufficient heat is applied to cause the thermoplastic material of one or both of the web fin and zipper flange to soften or melt in a zone defined by the face of the seal bar. Within the zone of overlap, opposing portions of the zipper flanges are joined to opposing portions of the fins of the web in respective band-shaped zones of joinder. In the embodiment depicted in FIG. 6, the softened or molten material fuses upon cooling to form the heat seals 12 and 16; whereas in the embodiments depicted in FIGS. 7 and 11, the softened or molten material fuses upon cooling to form the heat seals 40 and 42.

For the method of manufacture depicted in FIGS. 7-9, means are provided on the VFFS machine for folding the zipper flanges and then sealing the folded flanges together. For the method of manufacture depicted in FIGS. 10-13, means are provided on the VFFS machine for inserting a slider onto the zipper and then sealing the folded zipper flanges together.

Referring again to FIG. 14, the film is advanced by being pulled down intermittently in increments of advancement equal to the width of a package to be formed. The film web 2 is pulled downwardly by a pair of reciprocating cross-sealing bars 66, only one of which is shown in FIG. 14. The sealing bars are first brought together against a portion of the tubular film at a location where the film portion has descended below the lower end of the filling tube 58 in order to form a cross seal that joins mutually opposing band-shaped portions of the film, thereby closing the film tube to form a bottom of a pocket so that as product is dropped through the filling tube 58, that product is retained within the pocket. The cross-sealing bars 66 also form end seals on the hood. This transverse zone of joinder is later cut to provide a lagging side seam for one package and a leading side seam for another package. Essentially simultaneously with the sealing by the sealing bars, a cutting knife (not shown) is moved across the film to sever an individual previously filled package 68 from the work in process. The cross-sealing bars will again be brought together and then moved vertically downwardly to draw the film web 2 downwardly, thereby forming the next package around the filling tube 58.

The finished filled package comprises a receptacle having a hooded slider-zipper assembly 4 across its mouth. The receptacle comprises generally rectangular front and rear walls that are sealed together at the sides and folded at the bottom. To gain access to the contents of the filled package, the user must tear off the top of the hood. As previously disclosed, to facilitate tearing off a top and major portion of the hood, the zipper flanges are provided with respective lines of weakened tear resistance (indicated, e.g., by carets designated 32 and 34 in the drawings). In addition, a tear notch (not shown) can be provided at one or both ends of the hood, at the same elevation as the lines of weakened tear resistance. The consumer need only grasp the top seal 14 at one corner of the hood, initiate a tear at the tear notch at that same end of the hood, and then tear the hood along the aforementioned lines of weakened tear resistance.

Optionally, the portions of the zipper exclusive of the flanges may be ultrasonically stomped (i.e., deformed) at regular spaced intervals along the zipper's length (i.e., centered at the mid-lines of the cross seals formed later in the zipper-web assembly) to form slider end stop structures and to join the interlocked zipper strips together. The slider end stop structures will be bisected when the completed bags are severed from the work in progress, thereby forming one slider end stop at the trailing end of the zipper of the completed bag and another slider end stop at the leading end of the zipper of the next bag to be completed.

While the disclosed embodiments make reclosable bags using thermoplastic film, the continuous web of bag making material fed to the VFFS machine can be implemented in a wide variety of ways. It can be constituted merely by a single film of thermoplastic material, or by a composite film of thermoplastic material, i.e. a film built up by juxtaposing layers of different kinds, or indeed a composite film, e.g. constituted by plastic-coated paper or by a metal-coated film.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, welded, bonded, sealed, adhered, etc., whether by application of heat and/or pressure, application of ultrasonic energy, application of a layer of adhesive material or bonding agent, interposition of an adhesive or bonding strip, etc. Further, in the absence of explicit language in any method claim setting forth the order in which certain steps should be performed, the method claims should not be construed to require that steps be performed in the order in which they are recited.

The invention claimed is:

1. A method of manufacture comprising the following steps:

(a) interlocking a first profiled closure member of a first flanged zipper strip with a second profiled closure member of a second flanged zipper strip;

(b) inserting a slider on said first and second flanged zipper strips;

(c) folding a first zipper flange of said first flanged zipper strip and folding a second zipper flange of said second flanged zipper strip so that respective portions of said first and second zipper flanges confront each other at a position above said first and second profiled closure members;

(d) joining said mutually confronting portions of said first and second zipper flanges to each other to form a hood over said first and second profiled closure members;

(e) guiding first and second portions of web material into mutual confrontation, said first portion being disposed between said second portion and a first edge of said web material and said second portion being disposed between said first portion and a second edge of said web material when said web material is in a flattened state;

(f) guiding said mutually interlocked first and second zipper strips to positions whereat a portion of said first zipper flange confronts said first portion of web material and a portion of said second zipper flange confronts said second portion of web material while said hood is exposed and projects beyond said first and second edges of said web material;

(g) joining said portion of said first zipper flange to said first portion of web material;

(h) joining said portion of said second zipper flange to said second portion of web material;

(i) joining mutually opposing respective portions of said folded first zipper flange to each other; and (j) joining mutually opposing respective portions of said folded second zipper flange to each other.

2. The method as recited in claim 1, wherein said first and second portions of web material are respectively first and second portions of a single web, further comprising the step of paying out said single web from a supply roll.

3. The method as recited in claim 2, wherein said guiding step comprises the step of folding said single web.

4. The method as recited in claim 2, wherein said guiding step comprises the step of wrapping said single web around a fill tube of a vertical form-fill-seal machine.

5. The method as recited in claim 4, further comprising the following steps:

joining third and fourth portions of said web along mutually parallel first and second lines respectively that are generally transverse to an axis of said fill tube, thereby forming first and second cross seals;

dropping product through said tube and onto said first cross seal prior to formation of said second cross seal; and cutting said web and said first and second flanged zipper strips along first and second lines that intersect said first and second cross seals, said second cut line severing a filled bag from a remainder of said web and first and second flanged zipper strips.

6. The method as recited in claim 1, wherein steps (g) and (h) are performed prior to step (d).

7. The method as recited in claim 6, wherein step (c) is performed subsequent to steps (g) and (h) and prior to step (d).

8. The method as recited in claim 1, wherein step (d) is performed prior to steps (g) and (h).

9. The method as recited in claim 1, wherein steps (g) and (h) are performed prior to step (c).

10. The method as recited in claim 1, wherein step (c) is performed prior to steps (g) and (h).

11. The method as recited in claim 1, wherein said portions of said first and second zipper flanges that are joined to said first and second portions of said web are disposed between said first and second portions of said web.

12. The method as recited in claim 1, wherein said portions of said first and second zipper flanges that are joined to said first and second portions of said web are disposed outside said first and second portions of said web.

13. The method as recited in claim 1, further comprising the steps of:

forming a first line of weakened tear resistance in said first zipper flange; and forming a second line of weakened tear resistance in said second zipper flange.

14. A method of manufacture comprising the following steps:

(a) interlocking a first profiled closure member of a first flanged zipper strip with a second profiled closure member of a second flanged zipper strip;

(b) inserting a slider on said first and second flanged zipper strips;

(c) folding a first zipper flange of said first flanged zipper strip and folding a second zipper flange of said second flanged zipper strip so that respective portions of said first and second zipper flanges confront each other at a position above said first and second profiled closure members;

(d) joining said mutually confronting portions of said first and second zipper flanges to each other to form a hood over said first and second profiled closure members;

(e) guiding a web of bag making material in a machine direction through a vertical form-fill-seal machine with a portion or portions of said web being wrapped around a tube and with mutually confronting first and second fin portions of said web projecting away from and not wrapped around said tube, said first fin portion having a first edge and said second fin portion having a second edge;

(f) guiding said mutually interlocked first and second flanged zipper strips to positions whereat a portion of said first zipper flange confronts at least a portion of said first fin portion and a portion of said second zipper flange confronts at least a portion of said second fin portion while said hood is exposed and projects beyond said first and second edges;

(g) respectively joining portions of said first and second zipper flanges to said portions of said first and second fin portions of said web;

(h) joining mutually opposing respective portions of said folded first zipper flange to each other; and (i) joining mutually opposing respective portions of said folded second zipper flange to each other.

15. The method as recited in claim 14, further comprising the following steps:

(h) joining mutually confronting portions of said web along first and second transverse lines respectively, thereby forming first and second cross seals;

(i) dropping product through said tube and onto said first cross seal prior to formation of said second cross seal; and (j) cutting said web and said first and second flanged zipper strips along first and second lines that intersect said first and second cross seals, said second cut line severing a filled bag from a remainder of said web and zipper strips.

16. The method as recited in claim 14, wherein step (g) is performed prior to step (d).

17. The method as recited in claim 16, wherein step (c) is performed subsequent to step (g) and prior to step (d).

18. The method as recited in claim 14, wherein step (d) is performed prior to step (g).

19. The method as recited in claim 14, wherein step (g) is performed prior to step (c).

20. The method as recited in claim 14, wherein step (c) is performed prior to step (g).

21. The method as recited in claim 14, wherein said portions of said first and second zipper flanges that are joined to said first and second fin portions of said web are disposed between said first and second fin portions of said web.

22. The method as recited in claim 14, wherein said portions of said first and second zipper flanges that are joined to said first and second fin portions of said web are disposed outside said first and second fin portions of said web.

23. The method as recited in claim 14, further comprising the steps of:

forming a first line of weakened tear resistance in said first zipper flange; and forming a second line of weakened tear resistance in said second zipper flange.

24. A method of manufacture comprising the following steps:

(a) interlocking a first profiled closure member of a first flanged zipper strip with a second profiled closure member of a second flanged zipper strip;

(b) inserting a slider on said first and second flanged zipper strips;

(c) folding a first zipper flange of said first flanged zipper strip and folding a second zipper flange of said second flanged zipper strip so that respective portions of said first and second zipper flanges confront each other at a position above said first and second profiled closure members;

(d) joining said mutually confronting portions of said first and second zipper flanges to each other to form a hood over said first and second profiled closure members;

(e) guiding a web of bag making material into a configuration whereby first and second marginal portions of said web confront each other, said first marginal portion having a first edge and said second marginal portion having a second edge;

(f) guiding said mutually interlocked first and second zipper strips to positions whereat a portion of said first zipper flange confronts a portion of said first marginal portion of said web and a portion of said second zipper flange confronts a portion of said second marginal portion of said web while said hood is exposed and projects beyond said first and second edges;

(g) joining said portion of said first zipper flange to said portion of said first marginal portion of said web;

(h) joining said portion of said second zipper flange to said portion of said second marginal portion of said web;

(i) joining mutually opposing respective portions of said folded first zipper flange to each other; and (j) joining mutually opposing respective portions of said folded second zipper flange to each other.

25. The method as recited in claim 24, further comprising the following steps:

(i) joining mutually confronting portions of said web along first and second transverse lines respectively, thereby forming first and second cross seals;

(j) loading product into a volume defined by said side-sealed web prior to formation of said second cross seal; and (k) cutting said web and said first and second flanged zipper strips along first and second lines that intersect said first and second cross seals, said second cut line severing a filled bag from a remainder of said web and zipper strips.

26. The method as recited in claim 24, further comprising the steps of:

forming a first line of weakened tear resistance in said first zipper flange; and forming a second line of weakened tear resistance in said second zipper flange.

* * * * *